United States Patent [19]

Moore

[11] 4,429,677

[45] Feb. 7, 1984

[54] DISK LAUNCHING SYSTEM FOR GAMES

[76] Inventor: Ernest C. Moore, P.O. Box 24, Allano, Calif. 93544

[21] Appl. No.: 317,155

[22] Filed: Nov. 2, 1981

[51] Int. Cl.[3] ..... F41B 1/00

[52] U.S. Cl. ..... 124/62; 124/69; 124/70; 46/74 B; 273/424

[58] Field of Search ..... 124/42, 62, 69, 70; 273/424; 46/44, 74 R, 74 B, 74 D, 74 A

[56] References Cited

U.S. PATENT DOCUMENTS

| | | | |
|---|---|---|---|
| 1,290,050 | 1/1919 | Bay et al. | 124/62 |
| 2,733,699 | 11/1952 | Krinsky | 124/57 X |
| 3,046,966 | 7/1962 | Butler et al. | 124/70 |
| 3,190,654 | 4/1962 | Ross | 124/62 X |

FOREIGN PATENT DOCUMENTS

| | | | |
|---|---|---|---|
| 614740 | 12/1948 | United Kingdom | 124/62 |

*Primary Examiner*—Richard T. Stouffer
*Assistant Examiner*—B. Honaker
*Attorney, Agent, or Firm*—Ben E. Lofstedt

[57] ABSTRACT

A mouth-blown pneumatic system for launching disks used to play games, and the like, which includes a hollow housing having an air reservoir therein, a hose with one end connected to the air reservoir and the other end connected to a mouthpiece for blowing air thereinto, a disk launching chamber, a disk launching ramp within the disk launching chamber, a baffle inside the housing separating the air reservoir and the disk launching chamber, and a manually-operable valve for controlling the flow of air from the air reservoir to the disk launching chamber.

7 Claims, 2 Drawing Figures

FIG. 1
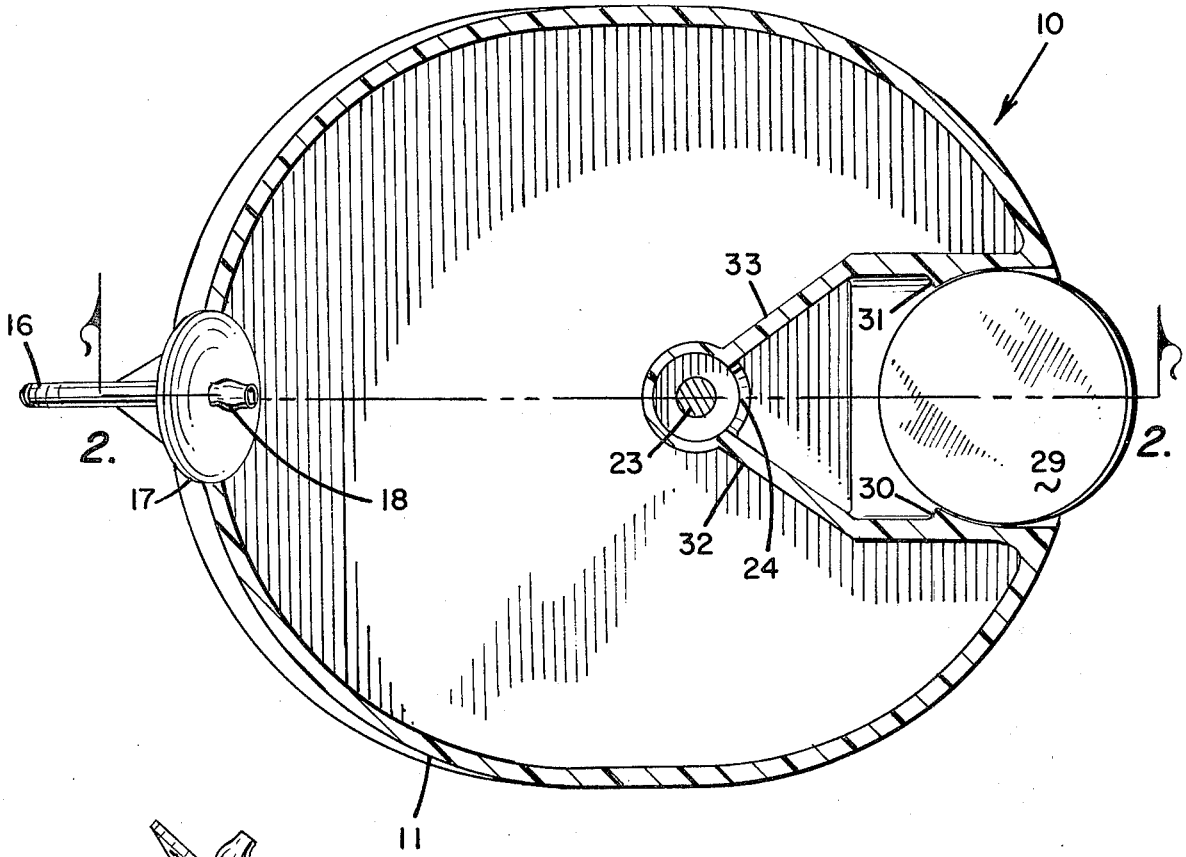
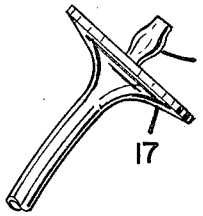
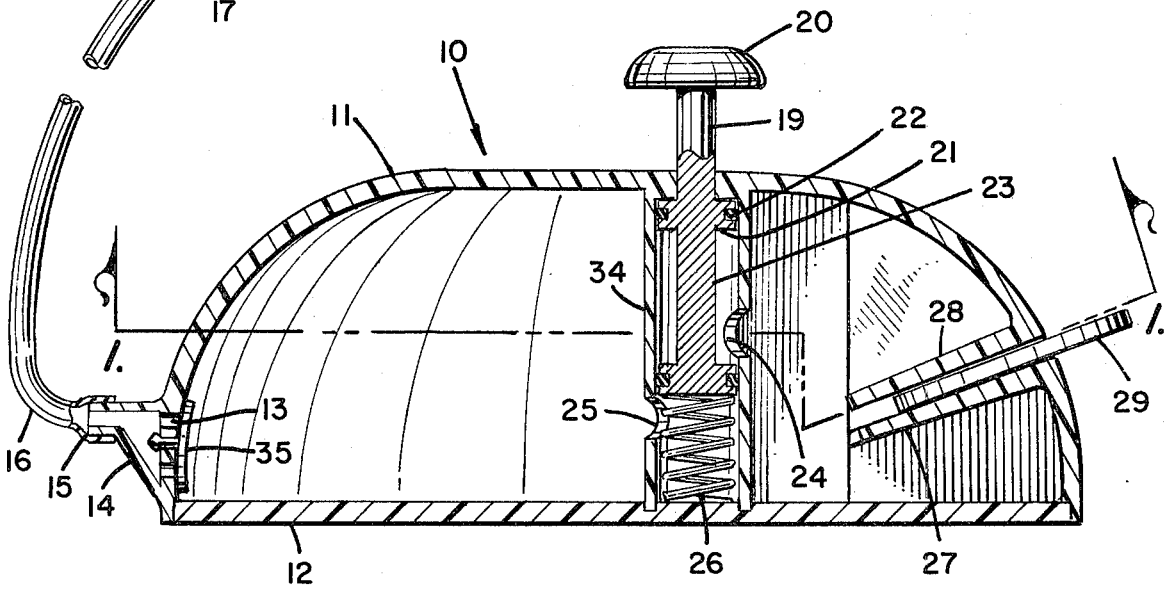
FIG. 2

DISK LAUNCHING SYSTEM FOR GAMES

BACKGROUND OF THE INVENTION

1. Field of the Invention:

The instant invention is in the field of pneumatically powered projectile launchers, and, more particularly, relates to mouth-blown game disk launching devices.

2. Description of the Prior Art:

The prior art is replete with various and numerous stored-energy, projectile launching systems. The stored energy may be released to launch a projectile by mechanically actuating a trigger mechanism forming a part of the housing containing the reservoir and launching mechanism.

Some of such examples known to the inventor herein are: U.S. Pat. Nos.: 2,170,373; 2,733,699; 3,046,694; 3,046,966; 3,739,764; 3,937,191 and 4,159,705.

The disk moving device disclosed in U.S. Pat. No. 2,170,373 employs a manually operable means for compressing the air within a housing having an air vent in the bottom thereof whereby when device is manually depressed, the air is compressed within the chamber and thereafterwards forced, under pressure, out the air vent. A disk positioned near the air vent will be propelled by the compressed air away from the air vent. This disk propelling device is not very efficient as it does not permit any substantial air pressure to be built up within the chamber because it is always vented, and is directing air towards the disk the instant the device is manually depressed, and does not provide a means for launching the disk into the air; it merely propells it along the ground or the surface of the game playing board.

U.S. Pat. No. 2,733,699 relates to a toy rocket launching mechanism and offers a relatively complex device for pneumatically launching a toy rocket. The rocket is propelled pneumatically away from a compressed air reservoir when it is released via a mechanical release or trigger mechanism; it does not employ a valve for triggering the release of the rocket as found in the present device disclosed herein.

Another type of pneumatic jet propelled toy rocket mechanism is disclosed in U.S. Pat. No. 3,046,694. In FIG. 3, there is shown a relatively simple air plunger and one-way ball/check valve mechanism for forcing compressed air into the hollow body of the toy projectile which is partially filled with a liquid such as water. When the air pressure inside the toy projectile reaches a level where it begins forcing the water out of the body of the toy projectile via the compressed air delivery passageway into the toy projectile, the toy projectile is launched under the power of the internal pressure and the jet of fluid material caused to be emitted from the compressed air delivery passageway which now functions as a nozzle.

Another type of compressed air toy rocket launcher is taught by U.S. Pat. No. 3,046,966. A series of air valves is used to control the delivery of compressed air into the hollow body of the toy rocket in order to launch it away from tube 106 which includes a closed end 118 fitting against the end of the tube 106 remote the base 110.

A toy rocket is disclosed in U.S. Pat. No. 3,739,764 in combination with an angularly adjustable cylindrical launch tube coupled to a special "firing" valve. The valve, in turn, is connected to a source of compressed air residing in an air reservoir formed by an expansible balloon. A hand operable air pump is coupled to the balloon for inflation via a check valve.

U.S. Pat. No. 4,159,705 details an air pump mechanism for charging an air reservoir and for shifting a pilot valve in order to launch the projectile away from the housing when the air pressure in the hose between the pump and the housing become sufficient great to do so.

None of the above devices known by the present inventor teach, disclose or anticipate the new and novel device disclosed herein.

SUMMARY OF THE INVENTION

The instant invention may be fundamentally characterized as a mouth-blown, pneumatic system for launching disks used in the playing of games. The present device consists of a hollow housing having an air reservoir therein, a hose with one end coupled to the air reservoir and the opposite end connected to a mouthpiece for blowing air thereinto, a disk launching chamber, a disk launching ramp within the disk launching chamber, a baffle inside the housing separating the air reservoir and the disk launching chamber, and a manually-operable valve for controlling the flow of air from the air reservoir to the disk launching chamber.

It is an object of the instant invention to provide a disk launching device which is safe, inexpensive and accurate.

Another object of the present invention is to provide a device of the type and character described herein which is extremely accurate by virtue of the substance base of the housing and the pre-set angle of the disk launching ramp.

A yet still further object of the invention is to provide a disk launching system for games which is mouth-operated and has a readily replaceable mouth guard about the air hose by which mouth blown air is introduced into the air reservoir within the housing.

Another important object of the invention is to provide a triggering device for operating a disk launching system which is foot-operable.

In order to achieve these objects and such further objects as may be set forth hereinafter, reference is made to the accompanying drawings, forming a part hereof, in which:

BRIEF DESCRIPTION OF THE DRAWINGS

FIG. 1 is a view taken along Plane 1—1 of FIG. 2 of the present invention.

FIG. 2 is an elevational view shown substantially in section taken along Plane 2—2 of FIG. 1 of the instant invention.

DESCRIPTION OF THE PREFERRED EMBODIMENT OF THE INVENTION

With reference now to the drawings herein, there is shown a mouth-blown, pneumatic system for launching disks used to play games, and the like, including: a hollow housing, generally indicated at 10, said housing comprising a top 11 formed as an inverted cup-shaped portion and a base 12 for sealing the bottom of the top 11, and having two air reservoirs therein separated by baffles 32 and 33 mated with the top 11 and the base 12 of the housing 10, an air hose 16 connected at one end to one of the air reservoirs within the housing 10 and terminated at its opposite end with a mouthpiece for blowing air thereinto, said mouthpiece consisting of a disk 17 and a nipple 18, a valve 21 for triggering the release of air stored in one of the air reservoirs into the other of said reservoirs, and a disk launching ramp formed by lips 27 and 28.

The housing 10 contains in this particular embodiment two valves; one being the triggering valve 21 and a one-way or check valve 35.

Further, within the housing 10 there are two air reservoirs; one is disposed between the valves 21 and 35; the second air reservoir is separated from the first air reservoir by the walls of the top 11 of the housing 10, the base 12 of the housing 10 and the baffles 32 and 33.

Within the second air reservoir is a disk launching ramp formed by lips 27 and 28.

It should be noted that the air hose 16 is friction futed over the nipple 15. The nipple 15 extends from its enlarged base 14 into a pair of apertures 13 which communicate with the first air reservoir.

A check valve or one-way valve 35 is formed by a flexible plastic disk having a centrally-disposed rod for anchoring it to the housing 10. Its operation will be detailed more fully as the description of the invention proceeds further herein.

The triggering valve 21 is a simple plunger type valve, as the valve spool 23 is shuttled back and forth by actuation of the stem 19 by manual or foot engagement with the cap 20, air is directed from the first air reservoir through the opening 25 into the triggering valve body and thereafter exits the opening 24 into the second air reservoir. A helically-wound spring 26 biases the valve spool 23 into its pre-triggered position as shown and illustrated in FIG. 2 of the drawings. In this triggering valve 21 position, no air is permitted to pass from the first air reservoir to the second air reservoir.

OPERATION OF THE INVENTION

The invention is quite simple to operate.

The user of the disk launching system initially places the nipple 18 in his mouth. No additional length of the air hose 16, other than the nipple 18, can be inserted into the user's mouth because of the disk 17 which is larger in diameter than the user's mouth, and hence, cannot physically be inserted thereinto. This is an important safety feature. Further, it is obvious that this portion, including the nipple 18, can be so constructed as to be removable for ready replacement to permit other users to operate the launching unit without transferring germs from one person's mouth to another person's mouth.

Once the nipple 18 is inserted, the person blows into the air hose 16. The air travels from the person's mouth into the air hose 16 and into the nipple 15 and its base 14 and into the first air reservoir inside the housing 10 via the openings 13 as the valve 35 flexes open. As the person stops blowing, the air pressure inside the first air reservoir being greater than simple atmospheric pressure, will force the valve 35 closed thereby preventing air within the first air reservoir from exiting therefrom via the air hose 16. The person continues to blow until he obtains the desired air pressure or until he simply cannot force any more air into the first air reservoir.

A disk 29 is pre-inserted into the disk launching ramp formed by the two lips 28 and 29. Note that the two lips are disposed at a slight upwardly directed angle in order to direct the disk in such direction into the air when it is launched and that the disk is cradled against stops 30 and 31 to limit further movement of the disk into the disk launching ramp throat.

To trigger and thereby launch the disk, the cap 20 is depressed either by hand or foot downwardly until the valve spool 23 uncovers the openings 24 and 25. When this occurs, the compressed air moves from the first air reservoir into the second air reservoir. When this occurs, compressed air is delivered into the disk launching ramp formed by the two lips 28 and 29 and against the edge of the disk disposed between the two stops 30 and 31. Thereafterwards, the disk is launched into the air towards its designated target, remote from the housing 10.

It has been determined that an average male adult can blow air to a pressure of 1.95 psig. In order to calculate the air pressure required to launch the disk, the following formulae and parameters are used for illustrative purposes:

If we define the following terms as follows:

P = air pressure in second air reservoir in lbs/in$^2$

A = area of disk in in$^2$ on disk launching ramp inside of second air reservoir $F_t$ = force, in lbs, needed to move disk from launching ramp W = weight of disk in lbs.

t = thickness of disk in inches

D = disk diameter in inches

Assuming that $F_t = 1.5$ W, then the formula becomes:

$$P = \frac{(2)\,(1.5\,W)}{\pi\,D}$$

Therefore, if we use as an example, a plastic poker chip weighing approximately 0.25 oz and is 1.75 inches in diameter and is 0.094 inches thick, then $$P = \frac{(1.15)\,(0.25)\,(0.0625)}{(1.75)\,(0.094)}$$

$$P = 0.11 \text{ psig,}$$

which is a figure which is below what the average male can blow, i.e., 1.95 psig.

The present invention has been described in relation to a preferred embodiment thereto. It is obvious to those of ordinary skill in the art, that they will be able to effect various alterations, substitutions of equivalents and other changes without departing from the original concept of the invention. It is, therefore, intended that the present invention be limited only by the definition contained in the appended claims.

What I claim as my invention is:

1. A mouth-blown pneumatic system for launching disks used to play games, and the like, comprising:

(a) a hollow housing, said housing having an opening for the delivery of air thereinto, and an elongated slot therein for the passage of a disk therethrough;

(b) a baffle and housing support means immediately disposed within said housing dividing said housing into first and second air reservoirs and providing structural support for said housing;

(c) an air valve for controlling the flow of air between said first and second reservoirs being actuatable from outside of said housing, said air valve being disposed within said baffle and housing support means and formed as a part of said baffle and housing support means;

(d) a pair of lips disposed in spaced-apart relationship to permit the insertion of a disk therebetween, said lips disposed in intimate abutting relationship to the inside housing surface about said slot, said lips being disposed at an upwardly directed launching angle with respect to the slot;

(e) an air hose, one end of which is coupled to said opening in said housing for the delivery of air thereinto and the other end used for receiving air thereinto, so that when air is blown into said other end of said air hose, air is delivered into the first reservoir and when said air valve is actuated, compressed air is delivered from said first air reservoir to said second air reservoir and into engagement with a portion of the rim of the disk disposed within said pair of lips serving as a disk launching ramp so that when said compressed air is so engaged with said disk, the disk is launched upwardly and through the slot in said housing into the air towards its intended target.

2. The disk launching system of claim 1, further comprising a nipple coupled to said air receiving end of said air hose for blowing air into the air hose by mouth.

3. The disk launching system of claim 2, further comprising a disk disposed about said air hose adjacent to said nipple, said disk being larger than the mouth of the person blowing air into said air hose via said nipple.

4. The disk launching system of claim 1, wherein said hollow housing includes a cup-shaped top portion and a flat bottom portion, said flat bottom portion being substantially co-extensive with the rim of said top portion and joined therewith in fluid-sealing relationship.

5. The disk launching system of claim 1, wherein said air valve is disposed within said housing and is plunger actuated, said plunger being disposed, in part, outside of said housing.

6. The disk launching system of claim 5, wherein said air valve is formed as a part of said baffle for dividing said housing into first and second air reservoirs.

7. The disk launching system of claim 1 further comprising a check valve disposed between said air hose and said first air reservoir, whereby when said air passes through said air hose into said first air reservoir the air cannot flow from said first air reservoir into said air hose.

* * * * *